United States Patent [19]

Pompei et al.

[11] 4,222,350

[45] Sep. 16, 1980

[54] EFFICIENT HEATING AND DOMESTIC HOT WATER APPARATUS

[75] Inventors: Francesco Pompei, Wayland; Joseph Gerstmann, Framingham, both of Mass.

[73] Assignee: Boston Gas Products, Inc., Boston, Mass.

[21] Appl. No.: 918,829

[22] Filed: Jun. 26, 1978

[51] Int. Cl.[3] ..... F22B 1/02

[52] U.S. Cl. ..... 122/32; 122/33; 122/367 C

[58] Field of Search ..... 122/32, 33, 367 C

[56] References Cited

U.S. PATENT DOCUMENTS

| | | | |
|---|---|---|---|
| 3,522,909 | 8/1970 | Arant | 122/33 |
| 3,701,340 | 10/1972 | Miller | 122/367 |
| 3,785,363 | 1/1974 | Machado | 122/33 |
| 3,802,396 | 4/1974 | Currie | 122/33 |
| 4,116,167 | 9/1978 | Hamilton | 122/33 |
| 4,143,816 | 3/1979 | Skadeland | 165/DIG. 2 |

*Primary Examiner*—Henry C. Yuen

*Attorney, Agent, or Firm*—Cesari & McKenna

[57] ABSTRACT

An efficient, compact boiler system providing both heating water for heating an enclosed space, such as a home, and domestic hot water for washing and similar purposes, has a limited fluid capacity primary heating coil within a combustion chamber. The coil supplies heated water to a larger capacity storage boiler located directly below the primary boiler and connected to it by header pipes which themselves form a manifold into which the primary coil is connected. The storage boiler distributes the heated water through the heating system. An elongated secondary heating coil within the boiler heats the domestic hot water supply by heat transfer from the boiler water. The return header pipe discharges heated water directly into the interior loop of the secondary coil to quickly heat the domestic hot water when the burner is "on".

5 Claims, 2 Drawing Figures

EFFICIENT HEATING AND DOMESTIC HOT WATER APPARATUS

BACKGROUND OF THE INVENTION

A. Field of the Invention

The invention relates to boiler systems and, more particularly, to boiler systems of moderate size which are particularly adapted for use in residential environments for providing hot water for both heating purposes and for domestic water purposes.

B. Prior Art

Boiler systems heat a fluid, commonly water, for subsequent use such as heating, cleaning, etc. Heretofore, boiler systems have typically been bulky, of limited efficiency and, not infrequently, noisy. Attempts have been made to improve these systems, with varying degrees of success.

Boiler systems with heater sections of compact design are known; examples are U.S. Pat. No 4,055,152 issued Oct. 25, 1977 to Maurice Vidalenq; U.S. Pat. No 3,701,340 issued Oct. 31, 1972 to Avy Miller; U.S. Pat. No. 3,630,175 issued Dec. 28, 1971 to Edward Reid, Jr; U.S. Pat. No. 3,704,748 issued Dec. 5, 1972 to William H. Hapgood; and U.S. Pat. No. 3,706,303 issued Dec. 19, 1972 to William H. Hapgood. These boilers are configured such that a substantial number of their components must be specially manufactured for them, and this greatly increases their cost. Further, their construction is such that a large amount of hand assembly is required during fabrication, and this also adds to their cost of manufacture, as well as to their cost of maintenance and repair.

Progress in the area of compact home heating systems has been slow. Examples of proposed structures include U.S. Pat. No. 3,773,019 issued Nov. 20, 1973 to William H. Hapgood; U.S. Pat. No. 3,800,747 issued Apr. 2, 1974 to William H. Hapgood; and U.S. Pat. No. 2,904,014 issued Sept. 15, 1959 to R. L. Meyers. Efficient design of the entire system for both minimum space utilization and high thermal efficiency has generally been lacking.

BRIEF SUMMARY OF THE INVENTION

A. Objects of the Invention

Accordingly, it is an object of the invention to provide an improved boiler system.

Further, it is an object of the invention to provide an improved boiler system that is compact, efficient, clean burning, and inexpensive to produce, and particularly adapted to residential use.

A further object of the invention is to provide a compact, efficient, quiet boiler system providing both heating water and domestic hot water.

Yet another object of the invention is to provide an improved boiler system which has low stand-by heat losses yet which is resistant to corrosive attack by condensed combustion products.

Another object of the invention is to provide a boiler system having low heat capacity yet which is not prone to rapid on/off cycling.

Still a further object of the invention is to provide large amounts of domestic hot water through more effective use of available heat transfer surface.

B. Brief Description of the Invention

In accordance with the present invention, a combustion chamber is formed by a primary heater coil of limited fluid capacity surrounding a flame holder and provided with heat insulating end caps at opposite ends of the coil, the flame holder extending through one of the end caps. The combustion chamber is encased in a generally cylindrical shell, the space between the shell and the primary heater coil forming a channel for the collection of cooled exhaust products.

The primary heater coil is formed by a pair of vertically disposed supply and discharge header pipes, respectively, and a plurality of multiple looped coil sections extending between the respective headers. The coil sections form a generally cylindrical enclosure, the interior of which serves as the combustion chamber for the burner. Thermally resistant insulating end caps are provided at both ends of the primary heater coil both to serve as heat insulations and to prevent escape of hot combustion gases around the primary heater coil. A centrally located and substantially cylindrical flame holder passes through a hole in one of the end caps, and distributes the flame products of combustion substantially uniformly along the axis of the primary heater coil, to thereby cause the flame products to flow generally radially through the coil.

Surrounding the coil is a generally cylindrical shell, in which the annular space between the shell and the coil serves as a collection space for the cooled products of combustion leaving the coil. One end of the shell contains penetrations for the supply and discharge header pipes, and for the centrally located flame holder. An exhaust port is also provided for the discharge of cooled products of combustion.

This construction provides excellent economy of manufacture since the primary heater coil is constructed from only the primary heat transfer surfaces themselves, plus fairly inexpensive and readily available supply and discharge header pipes to which they are readily joined by brazing or welding. The header pipes serve both as the inlet and outlet manifolds and as the structural support for the primary heater coils themselves. Thus, separate manifolds for the primary coil are not required and additionally the supporting structure for the primary burner is greatly simplified. Further, since the primary coils form the major part of the combustion chamber enclosure, the requirement for refractory materials is minimized, the only such material required being the insulating end caps. This reduces the cost of insulating the heater, since the insulating ends caps may be made of relatively low cost fibrous insulating material which is simply pressed between the primary heater coil and the outer shell for the lower end cap and which is fastened to the coil for the upper end cap.

As noted above, the primary coil is supported within the shell by its supply and discharge header pipes. These may be welded or brazed to the shell at their respective points of penetration, or may be removably attached by the use of screwed or flanged fittings. Such attachments positively locate the primary heater coil and its insulating end caps with respect to the outer shell without the need for any additional structural support. These features provide an extremely economical and durable construction which provides efficient heat exchange within a compact enclosure.

The construction also achieves the objective of providing uniform distribution of flame products of combustion within the combustion chamber, as well as uniform residence time of these products from the time of combustion to the time of quenching within the primary heater coil. This is of great importance since the formation of certain noxious pollutants, especially carbon monoxide and oxides of nitrogen, is minimized for a given combustion chamber volume when the residence time of all products of combustion is made more uniform. Similarly, the symmetrical dispostion of the primary coil with respect to the flame holder produces a more uniform velocity of combustion products through the coil to thereby provide the most effective heat transfer for a given heat exchanger coil.

The primary coil is formed with a limited fluid capacity; in the preferred embodiment described here, this capacity is of the order of two to three pints of fluid. This provides several advantages. To begin with, the limited capacity of the coil insures that it is quickly brought up to the temperature above which condensation of the combustion products on it no longer takes place. Since the condensed combustion products are generally highly corrosive, this limits the amount of time that such condensed products are in contact with the coil and thereby limits coil corrosion. Second, since the primary heater coil communicates with the exhaust stack, the limited fluid capacity of the primary heater coil limits the heat lost up the stack by air convection over this coil when the boiler is not being fired; this promotes operating efficiency.

The fired boiler section is mounted directly above a transfer boiler of much larger capacity (e.g. 18 gallons) and the supply and discharge headers of the primary heater coil connect into the transfer boiler. The transfer boiler in turn is connected directly to the home heating loop which may comprise a conventional baseboard heater or which may comprise a heat exchange unit for a forced hot air system.

The transfer boiler has an elongated secondary coil extending vertically in the interior thereof and immersed in the boiler water. One end of the secondary coil is connected to a cold water inlet line; the other end is connected to the domestic hot water distribution lines and supplies to the latter water that is heated indirectly through heat transfer from the boiler water. The discharge header pipe which conveys heated fluid from the primary heating coil to the transfer boiler is positioned to discharge the heated water through the interior of the loop formed by the secondary heater coil. This creates a circulatory current over the tubing of this coil and promotes rapid heat transfer from the freshly heated water to the domestic hot water supply so that the latter is quickly brought to its desired temperature when called for.

DETAILED DESCRIPTION OF THE INVENTION

Figure 1:
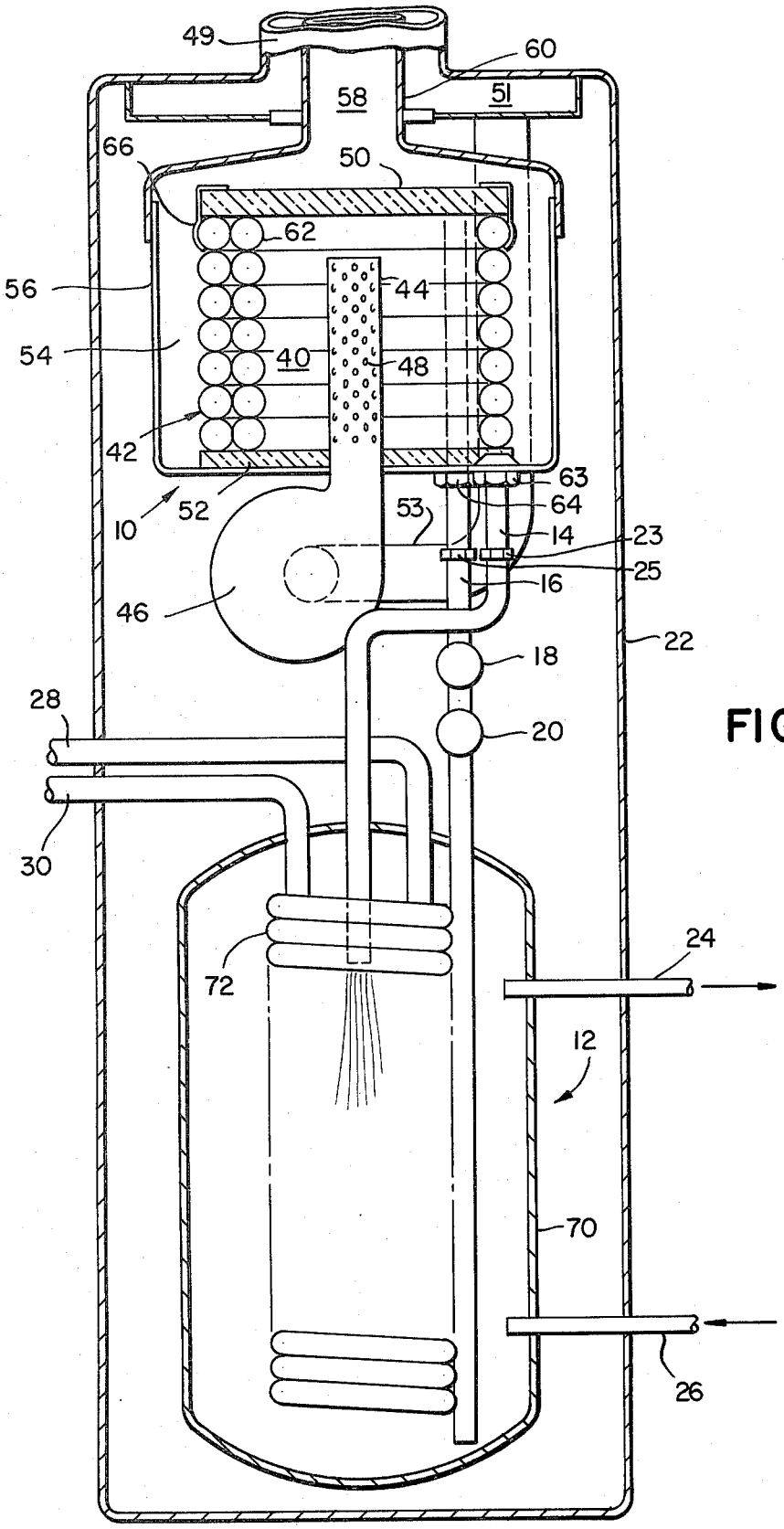
Figure 2:
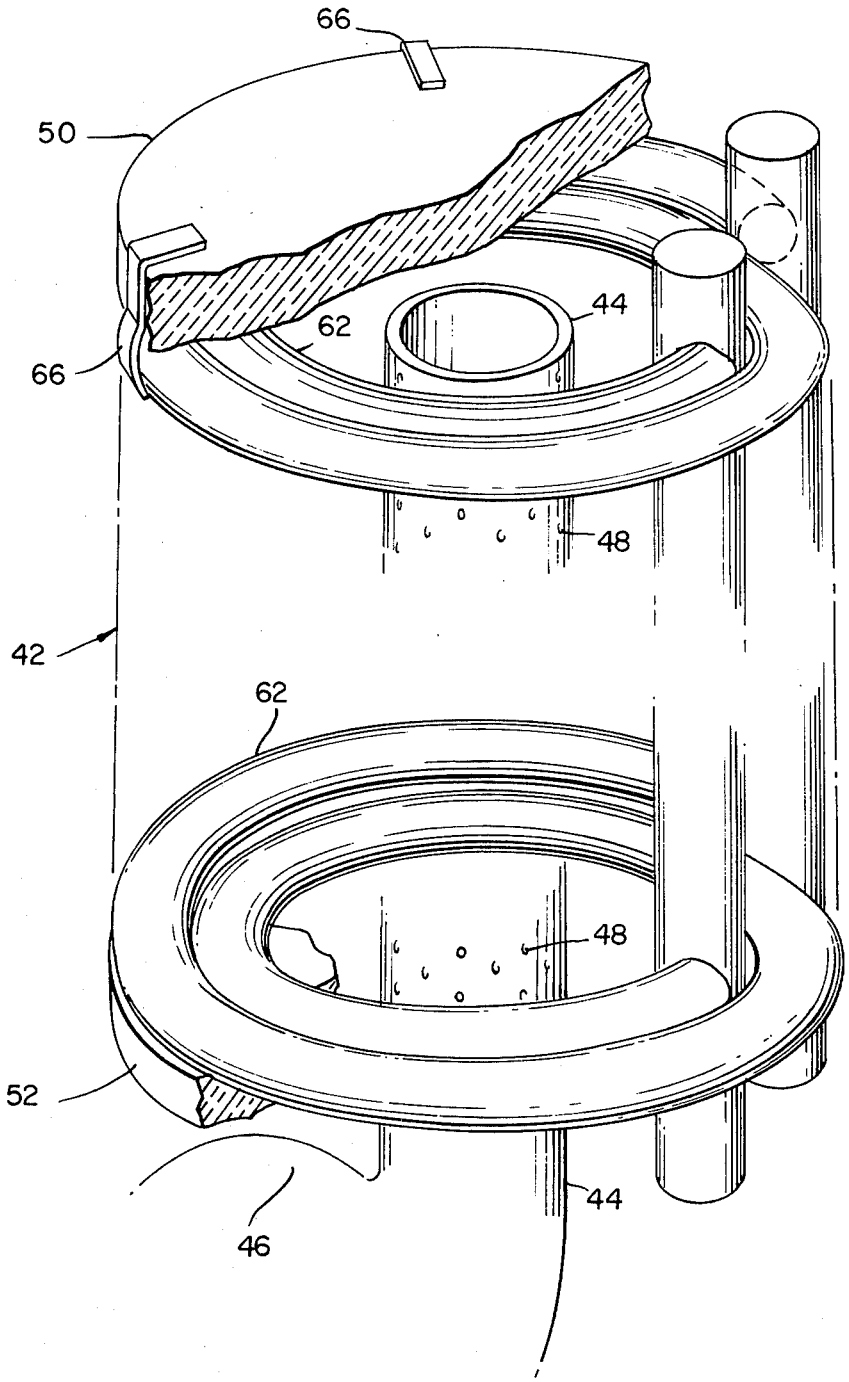

The foregoing and other and further objects and features of the invention will be more readly understood when taken in conjunction with the accompanying drawings in which;

FIG. 1 is a vertical sectional view of a preferred embodiment of the invention; and FIG. 2 is a view in perspective of the fired boiler section of FIG. 1.

In the drawings, the boiler system of the present invention is formed from a primary boiler 10 positioned above, and communicating with, a secondary boiler 12 by means of header pipes 14, 16. A circulator pump 20 transfers fluid under pressure from the secondary boiler 12 to the primary boiler 10, while a check valve 18 prevents backflow of fluid between the boilers during the standby or "off" period. Couplings 23, 25 allow decoupling of the upper sections of header pipes 14, 16 from the lower sections thereof. A shroud 22 encloses the boilers and a first set of pipes 24, 26 penetrate the shroud 22 and the boiler 12 for circulating water through the heating system, such as through radiators, while a second set of pipes 28, 30 penetrates the shroud 22 and the boiler 12 to supply domestic hot water for cooking, washing, and other purposes.

Considering now the boiler 10 in more detail, it comprises a combustion chamber 40 defined by a primary heater coil 42 of finned tubing (fins not shown) surrounding a flame holder 44 having a closed end face. Air drawn in through an outer stack 49 passes through a plenum chamber 51 and thence through a conduit 53 to a blower 46. Gas is supplied to the blower, preferably through a zero pressure regulator (not shown) and the blower feeds the resultant air-gas mixture to the flame holder 44 where it is discharged through ports 48 distributed about the periphery of the flame holder for combustion thereon. An upper end cap 50, and a lower end cap 52, both of refractory or other flame-resistant and heat insulating material, seal the combustion chamber 40 so that the combustion products pass outwardly out of this chamber through the interstices of the fins of the coil elements of the heater coil 42. These combustion products are collected in the annular chamber 54 formed between the outer face of the coil 42 and the inner face of a generally cylindrical shell 56 surrounding the coil 42. The chamber 54 communicates directly with an exhaust port 58 formed by a chimneyed cap 60 fitting over the shell 56. The exhaust port 58 positioned within the outer stack 49 provides a thermally balanced construction which limits air circulation through the stack 58 when the burner is "off." This contributes to the operating efficiency of the system.

The primary heater coil 42 comprises a plurality of multiply-looped coils 62 closely packed in parallel with each other surrounding the flame holder 44 and having their respective ends extending directly through the walls of the corresponding headers 14, 16 to form a plurality of parallel fluid paths between the headers. Preferably the coil sections are formed of integrally finned tubing for improved heat transfer. Fluid within these coil sections is heated as it passes from one header to the other. The coil sections are secured to the headers at their intersections by welding or brazing, and thus are mechanically supported by the headers. This greatly simplifies the construction process, and eliminates separate and specially formed manifolds. Thus, conventionally available tubing can serve not only as the supply and discharge conduits but also as the fluid manifolds, thereby greatly reducing construction and assembly costs.

The shell 56 supports the lower end insulating cap 52. The shell is connected to the header pipes 14, 16 by means of bulkhead fittings 63, 64. These fittings removeably attach the shell to the header pipes and facilitate snugly fitting the lower end cap against the coil 42 to close off the lower face of the combustion chamber 40. Further, the fittings 63, 64 facilitate repair or adjustment of the combustion chamber 40 and its components during use. End cap 50 is simply snapped on to the upper coil section of coil 42 by means of a flexible press-fit clamp 66 secured to the end cap and sliding over the upper coil section.

The construction of the primary boiler so described readily lends itself to a simple forming operation with of respect to the major components of the primary boiler such as the coil 42 and headers 14, 16. Further, assembly is greatly facilitated because of this construction and this further reduces the cost of the boiler.

Considering the secondary boiler 12 in more detail, it comprises a thin-walled tank 70 into which the headers 14, 16 lead. Insulation such as fiberglass or other material (not shown) preferably surrounds the boiler 12 within the shell 22 to minimize heat loss. An elongated coil 72, terminating in pipe extensions 28, 30, is immersed in the tank and provides domestic hot water by heat transfer from fluid within the tank 70. The header 14, which comprises the discharge or return header from the boiler 10, is positioned to discharge its contents directly into the interior of the loop formed by coil 72. The turbulence caused in the interior of the loop by this discharge greatly facilitates heat transfer to the fluid within the coil 72 and thus, when the burner is "on" and heated water is being discharged into the coil, the domestic hot water is brought up to the requisite temperature far more rapidly than is the case with conventional boiler systems.

The relative proportions and dimensions of the components of the system so far described depend on the varying applications to which the unit is put, and will change somewhat with these applications. However, for a typical residential heating and domestic hot water system, the coil 42 may advantageously be formed from an integrally-finned copper tubing having an inside diameter of approximately 0.5 inches and in outside (finned) diameter of 0.75 inches to form a coil having an inside diameter of $5\frac{1}{2}$ inches, an outside diameter of $8\frac{1}{2}$ inches, and a height of 6 inches; such a coil has a capacity of two to three pints of water. The boiler 12 advantageously has an overall diameter of 15 inches, a height of 27 inches, and a capacity of approximately 18 gallons. The coil 72 is preferably formed of integrally finned copper tubing having an outside (finned) diameter of $\frac{7}{8}$ inches and is 30 linear feet in length.

The boiler 12 provides a reservoir of hot water for the heating and domestic hot water system and additionally provides a large thermal mass which prevents excessive cyling of the burner 44. When the temperature of the fluid within the boiler 12 drops below the lower cut off limit, the boiler 10 is turned "on" and the circulator 20 is energized to thereby circulate water from the boiler 12 through the supply header 16, through the coil 42, and thence back to the boiler 12, after heating, through the return or discharge header 14. During intervals when the boiler 10 is "off", heat loss occurs in the primary coil 42 which is directly connected to the discharge port 58. However, the capacity of the primary coil is limited (2–3 pints) and thus the total amount of heat loss from it is greatly minimized in contrast to conventional boiler systems. Further, because of its limited capacity, it is quickly brought up to a relatively high temperature above the condensation temperature of the combustion products, and thus the length of time during which these products condense on it during the initial firing up is limited. This greatly prolongs boiler life. The fluid capacity of the primary boiler coil is a function of the heat input to the coil. We have found that a fluid capacity of not greater than 4 pints for each 100,000 BTU/hour heat input to the burner is most advantageous in securing the benefits of the present invention, and the term "limited fluid capacity" is to be understood in this context. In the preferred embodiment described herein, the capacity is in fact 3 pints/125,000 BTU/hour heat input.

CONCLUSION

From the foregoing, it will be seen that we have provided an improved boiler system that is compact, efficient, and especially suited to supplying both domestic hot water and hot water for heating purposes. The unit is particularly suited to residential applications where a quiet, compact and efficient unit is especially desirable. In addition to providing excellent heat transfer characteristics, the design of the primary heater coil minimizes the corrosion normally accompanying combustion, and also minimizes heat losses during burner "off" times. The system effectively separates the varying demands on the primary heater coil and those of the heating loop and the domestic hot water loop, while yet maintaining rapid response to demand for domestic hot water. These and other features of the system described herein have resulted in a calculated seasonal efficiency, confirmed by measurements, of from 75–80%, an unusually high efficiency for domestic heating and hot water systems.

Having illustrated and described our invention, we claim:

What is claimed is:

1. A boiler system comprising:

A. a primary boiler of limited fluid capacity having a plurality of stacked coils surrounding a heat source for heating fluid within said coils B. a transfer boiler for storing a substantially larger quantity of heated fluid therein and having an elongated coil positioned within said transfer boiler and heated by the fluid therein, and C. first and second header pipes interconnecting said primary boiler and said transfer boiler and respectively penetrated directly by the corresponding ends of said coils to form a fluid loop interconnecting said boilers, a first of said header pipes being positioned to discharge heated fluid from said primary boiler directly into the interior of said elongated coil to facilitate heat transfer thereto.

2. A boiler system according to claim 1 which further includes (1) a thin-walled shell penetrated by, and substantially supported from, said header pipes and surrounding said primary boiler coils to provide an exhaust products collector therefor, (2) a first refractory end piece spanning a lowermost one of said coils and resting on a lower face of said shell, and (3) a second refractory end piece spanning an uppermost one of said coils and clamped thereto.

3. A boiler system according to claim 2 which further includes first and second bulkhead fittings removeably securing said shell to said coil.

4. A boiler system according to claim 1 in which said elongated coil comprises a closely wrapped coil of finned tubing extending from an upper portion of said transfer boiler toward a lower portion thereof and in which a second of said header pipes is positioned to discharge heated water through the interior loop of said elongated coil to thereby enhance heat transfer into said coil.

5. A boiler system according to claim 1 in which said header pipes provide the primary support for said primary boiler.

* * * * *